US007637797B2

(12) United States Patent
Dieckmann

(10) Patent No.: US 7,637,797 B2
(45) Date of Patent: Dec. 29, 2009

(54) TOY VEHICLE AND TRACK SYSTEM

(76) Inventor: Winfried Dieckmann, Gottliebenstrasse 13, CH-8289 Kreuzlingen (CH)

( * ) Notice: Subject to any disclaimer, the term of this patent is extended or adjusted under 35 U.S.C. 154(b) by 849 days.

(21) Appl. No.: 11/406,199

(22) Filed: Apr. 18, 2006

(65) Prior Publication Data

US 2006/0276102 A1 Dec. 7, 2006

(30) Foreign Application Priority Data

Apr. 21, 2005 (DE) ..... 10 2005 018 535

(51) Int. Cl.
*A63H 18/10* (2006.01)

(52) U.S. Cl. ..... 446/444

(58) Field of Classification Search ..... None
See application file for complete search history.

(56) References Cited

U.S. PATENT DOCUMENTS 3,668,499 A * 6/1972 Malloy ..... 318/587
4,854,909 A * 8/1989 Ishimoto ..... 446/129
4,878,876 A * 11/1989 Ishimoto ..... 446/446

* cited by examiner

*Primary Examiner*—Ronald Laneau
*Assistant Examiner*—Tramar Harper
(74) *Attorney, Agent, or Firm*—Ladas & Parry LLP

(57) ABSTRACT

The vehicles of toy vehicle and track system are guided by magnetic coupling of a pilot magnet with a metal wire, or a metal band of a guiding track embedded in a roadway along this said track. By means of an additional, remotely controlled steering mechanism foreseen in each vehicle, the said vehicles can be steered away from their current guiding track to a neighboring guiding track, so that a play close to reality takes place.

10 Claims, 7 Drawing Sheets

TOY VEHICLE AND TRACK SYSTEM

This invention relates to a toy track system with vehicles propelled independently from each other, and with one or more adjoined guiding tracks embedded in a roadway.

For the majority of conventional toy car track systems, a pin, or a keel, situated at the underside of the car, which moves in a groove of the track body, guides the vehicles. These systems are customarily called slot car systems. Adversarial here is the limited interference of the drive operation with reduced facility, or lacking facility for changing lanes, which is comparable with railway vehicle systems.

The EP 0253297 (the U.S. Pat. No. 4,854,909) describes a solution where a guiding pin is lifted temporarily out of the slot, in conjunction with a fractional steering movement of the front wheels, in order to change lanes represented by slots. Nevertheless, this functions only partially in practice, because the pin does not always find the other slot, and in the curves, the fixed steering movement of the front wheels is not sufficient to compensate for the centrifugal force.

A vehicle steered through a magnet about a wire in the roadway, describes GB 784805. Besides, there are variations in which a mechanical or an electro-magnetic servomechanism delivers supporting forces. Also, the possibility exists, whereby remotely controlled fork-junctions in the guiding wire can be used for the direction change. However, arbitrary intervention in the steering system is not possible.

A vehicle likewise describes the U.S. Pat. No. 3,206,891 that is steered by a magnet along a wire. The actuation occurs here about a swinging magnet, which is energized by a field coil in the roadway, and this is why the vehicle functions without active propulsion. Intervention to change to a nearby second roadway coil, is supposed to be possible by changing the magnetic field of the roadway coils, while the guiding magnet is directly above the position of the shortest distance between the coils. As an alternative, a version is described which shows instead of the pilot magnet, a magnetic servo drive, which is likewise energized about the roadway coil, and thus permits direct remote control, including the change to the nearby second roadway coil. Besides, the steering system is firmly coupled with the servo drive. Field coils in the roadway, providing the magnetic force necessary for the steering, are very costly, and suitable impulse transference is to be achieved only with very rough roadway surfaces, and at low speeds.

The principal object of the invention is to provide a vehicle and track system of the afore said kind, whose vehicles can change in every segment of the roadway of a guiding track onto another, so that a relative movement of the vehicles to each other is possible, similar to that of a real car race; all without applying excessively high requirements on the ability of the players. The solution to this task is based on the identifying features of patent claim 1. Favorable embodiments of the invention are objects of the dependent claims, and will become apparent from the following description, taken in conjunction with the drawings, in which:

Figure 1:
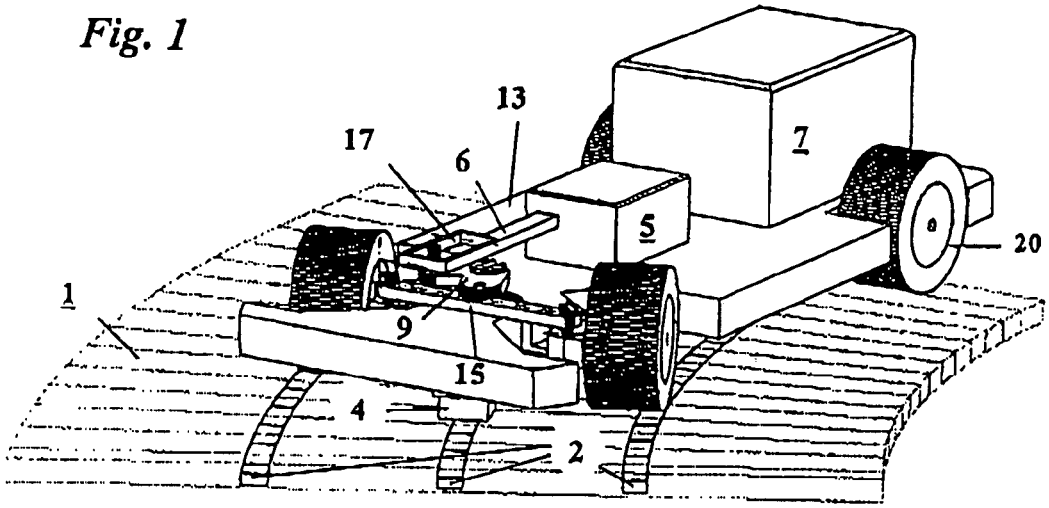
FIG. 1 is a perspective schematic diagram of a vehicle embodying the invention with a partial view of a sectional form of appropriate roadway.
Figure 2:
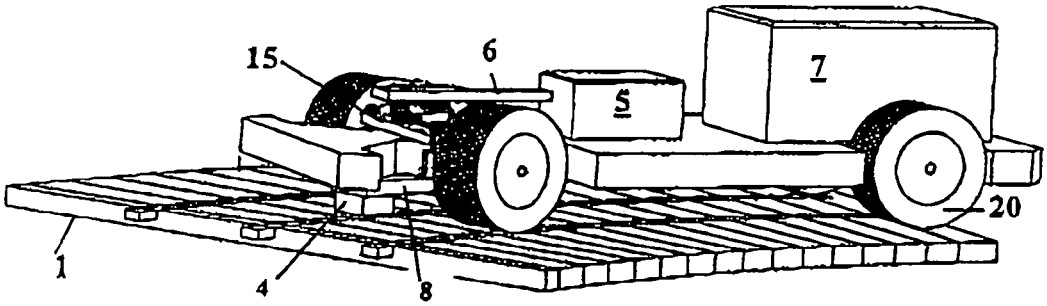
FIG. 2 is the arrangement to FIG. 1 from another angle.
Figure 3:
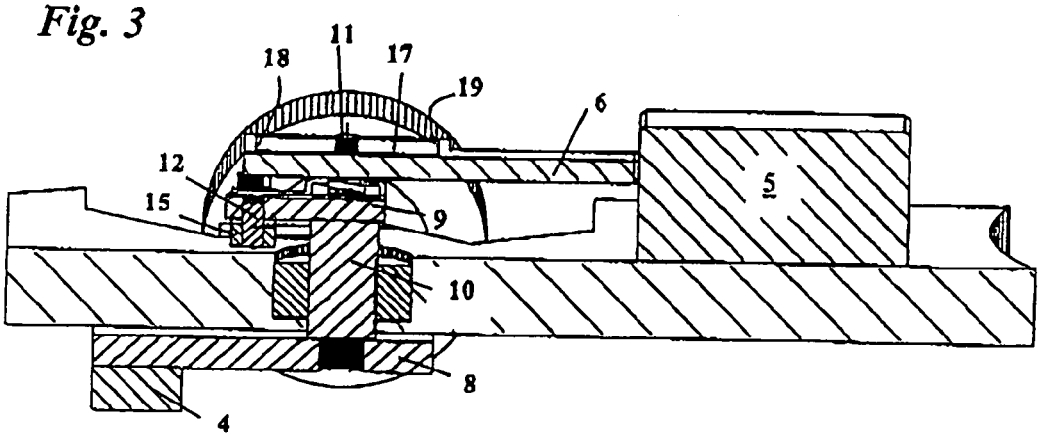
FIG. 3 is a longitudinal section of the steering mechanics of the vehicle to FIG. 1.

Referring to FIGS. 1 and 2, provision is made for three guiding tracks 2 in the roadway 1 with the same distance to each other, so that a vehicle 13 running on the inner track can be overtaken on the outer track. As a matter of course, the roadway can feature arbitrarily many, and also crossing guiding tracks, to bear resemblance to road traffic.

The guiding tracks 2 consist each of one in the roadway 1 enclosed metal wire or metal tape, so that they can guide the vehicle 13 by forces of magnetic coupling with the pilot magnet 4 attached. Because to the avoidance of frictional resistance, the magnetic coupling can occur with distance or without touch, the guiding tracks 2 are hidden, preferably invisibly, under the roadway surface, in case they are not used for the electricity supply.

With direct vehicle guidance the pilot magnet 4 following the guiding track 2 controls mechanically a steering mechanism, which is implemented as a steering trapezoid 3. Hereunto the pilot magnet 4 is fastened at the outer end of a pivot arm 8, which works about a steering shaft 10, firmly linked to it on an arm 14 of an angle lever 9, and about this by means of a plug 12, on the tie rod 15 of the steering trapezoid 3.

To steer a vehicle 13 guided by one of the magnetic tracks 2 away from this to a neighboring track 2, an additional steering means is foreseen, which is independent from, and superior to, the steering by the guiding tracks 2 and pilot magnet 4. Hereunto the vehicles 13 have in each case a remotely controlled electromechanical servomechanism 5 with a control lever 6, which works on the other arm 16 of the angle lever 9, and can shift therefore likewise the tie rod 15.

A cut 17 in the control lever 6 ensures sufficient free space for the steering plug 11, attached to the angle lever 9, to follow the steering movements given by the pilot magnet 4, following the guiding track 2, without being limited by the control lever, as long as it is in neutral position.

Figure 5:
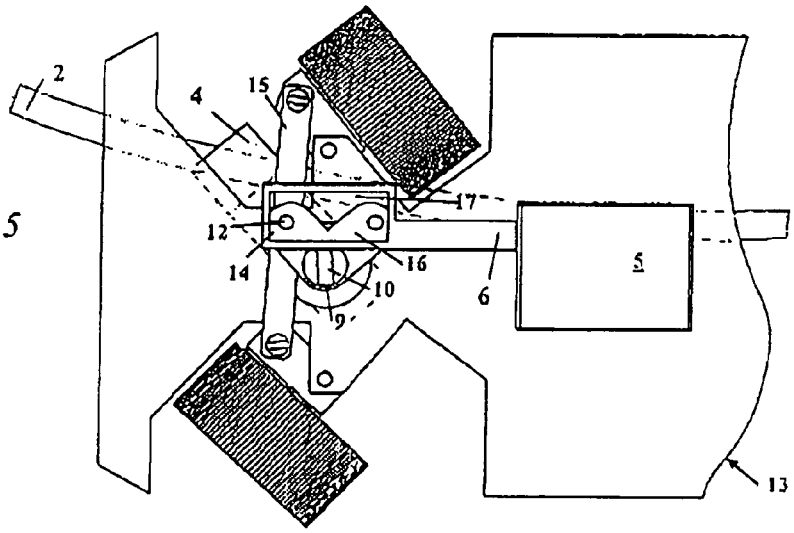
FIG. 5 is the steering mechanism to FIG. 4 following a right turn of the roadway.
Figure 6:
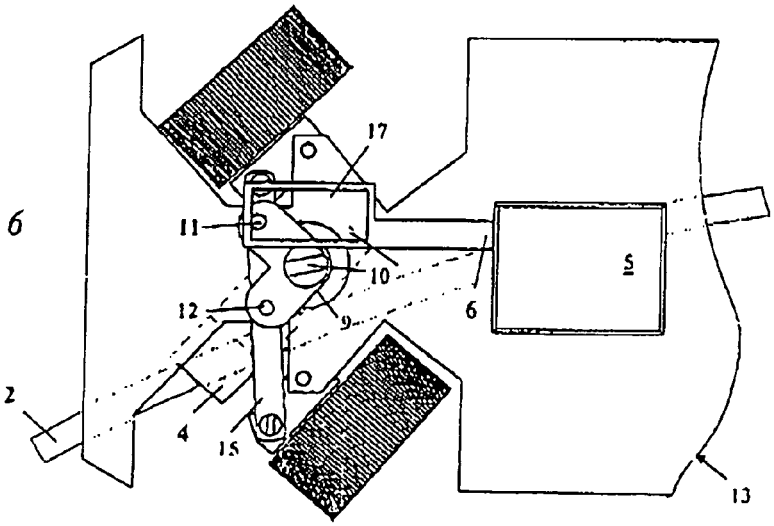
FIG. 6 is the steering mechanism to FIG. 4 following a left turn of the roadway.

FIGS. 5 and 6 illustrate the steering positions resulting from the maximum possible steering angle, and show the according end positions of the steering plug 11 within the cut 17 of control lever 6, if the vehicle is steered by the guiding track only.

Figure 4:
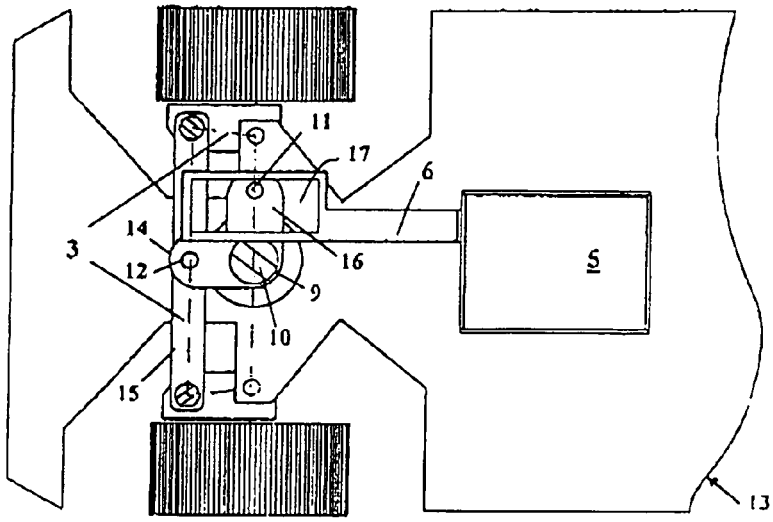
FIG. 4 is a plan view on the steering mechanism of the vehicle to FIGS. 1 to 3 driving straight in magnetic coupling with a track wire, without any intervention by a remote control.
Figure 7:
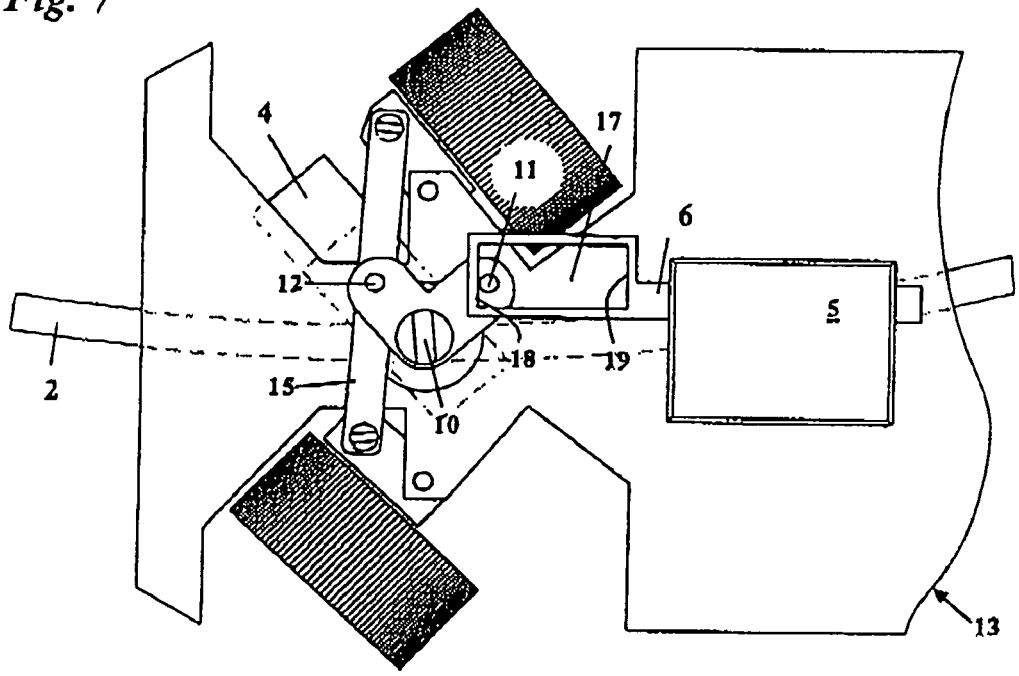
FIG. 7 is a plan view on the steering mechanism performing a remotely controlled right turn.
Figure 8:
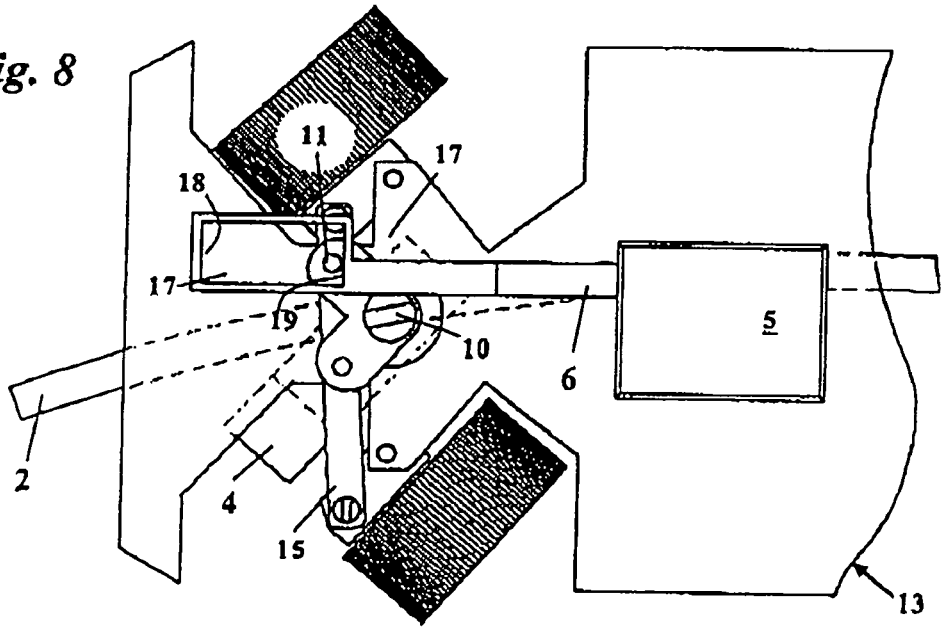
FIG. 8 is a plan view on the steering mechanism performing a remotely controlled left turn.

In order to change lanes, meaning to steer the vehicle 13 to a neighboring guiding track 2, the remotely controlled electromechanical servo system 5 moves the control lever 6 away from neutral position shown in FIGS. 4 to 6, so that the steering plug 11, in contact with one of the two bordering faces 18 or 19, is moved back or forth, limited by the end positions shown in FIGS. 7 and 8, and representing the maximum steering angle. Applying a force overriding the magnetic coupling force between the pilot magnet 4 and the guiding track 2 does this. Therefore a turn of the angle lever 9, which is coupled with the tie rod 15, can be carried out either by the movement of the pilot magnet 4, or by the shear or tensile movement of the control lever 6.

So that upon a remote control signal the servomechanism 5 can override the strength of the magnetic coupling, which is between the pilot magnet 4 and the ferromagnetic wire or belt forming the guiding tracks 2, it has sufficient power for this purpose, which can be achieved by a step-up gear unit. Nevertheless, means can be foreseen to lift up the pilot magnet 4, during the arbitrary steering movement of the servomechanism 5, so that the force of attraction of the pilot magnet, which is preferably implemented as a permanent magnet, is at least weakened.

Figure 9:
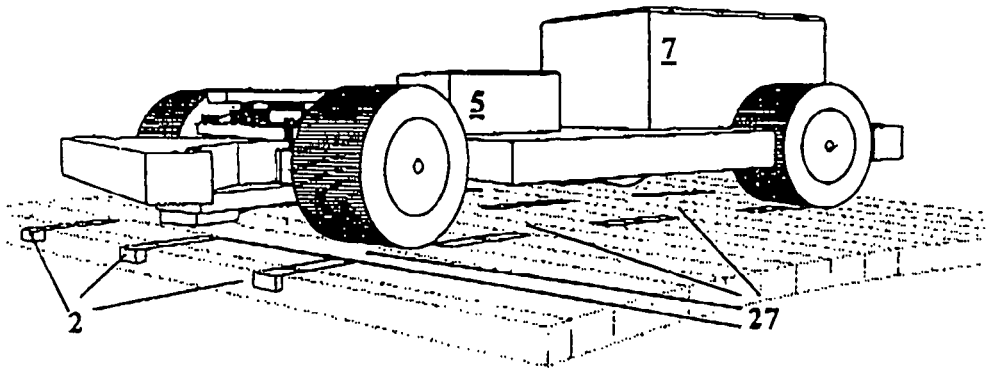
FIG. 9 is a perspective schematic diagram of a vehicle on a roadway part featuring interrupted guiding tracks.

In a further embodiment of the invention, the force necessary for an arbitrary steering movement can be also reduced by the fact that the ferromagnetic guiding tracks 2 have interruptions 27, periodically following on each other, as they are shown in FIG. 9. Consequently the magnetic coupling with the guiding tracks 2 is interrupted periodically during the movement of the vehicle, so that for a lane change, a substantially lower steering force is sufficient.

In variation of the described embodiment of the invention, a direct mechanical coupling of the pilot magnet 4 and the pilot arm 8 with the tie rod 15, can be abandoned, so that the magnet following the guiding track serves merely as a transducer for its relative movement to the vehicle, and any steering movement results from a common servo mechanism, which is controlled both by the signal of such a magnetic transducer and, in case of the human intervention, through the signal of a remote control.

Within the scope of the invention, numerous embodiments are possible, e.g. with different steering mechanisms and different servomechanisms. Also, different drives are possible, either with accumulators integrated in the vehicle 13, or with external electric power supply through conductors in the roadway, and sliding contacts attached to the vehicle. Also, the drive can work either on both rear wheels 20, or only on one e.g. centrally positioned wheel.

Also the remote control can be of various kinds e.g., radio, infrared, through conductors in the roadway or ultrasonic. U.S. Pat. No. 3,314,189 describes a remote control by light of different light wave lengths, as well as an electric power supply by contacts in the roadway of alternating polarity, and the DE 2919933 describes a remote radio control. Nevertheless, both differ from the invention described here by a firm coupling of the steering system, as well as the absence of a magnetic guidance.

Figure 10:
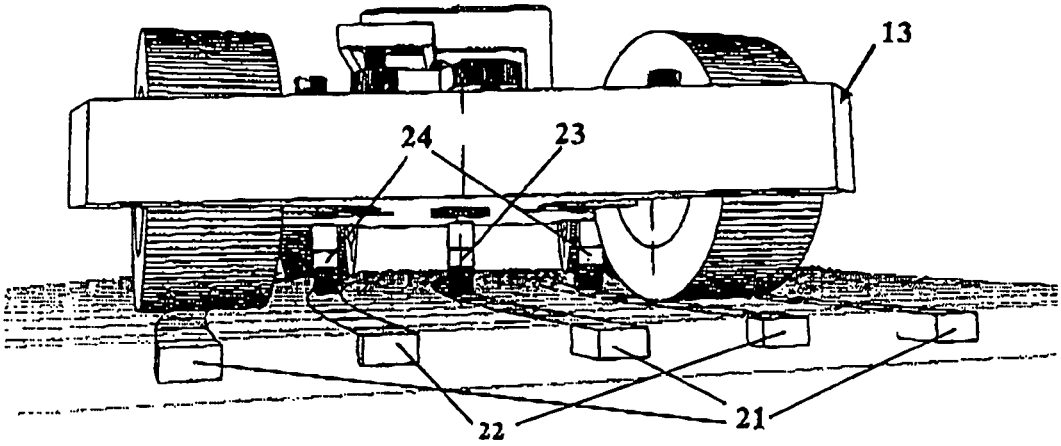
FIG. 10 is a perspective schematic diagram of a vehicle on a roadway part with uninterrupted electric contact tracks.

According to the embodiment illustrated in FIG. 10, one of the conductors necessary for the power supply through the sliding contacts 23, 24, is formed by the magnetic guiding track 21, and the second necessary conductor 22 for one of the sliding contacts 23, 24 is additionally positioned in parallel and consist of a non-magnetic metal, as for example: copper.

Figure 11:
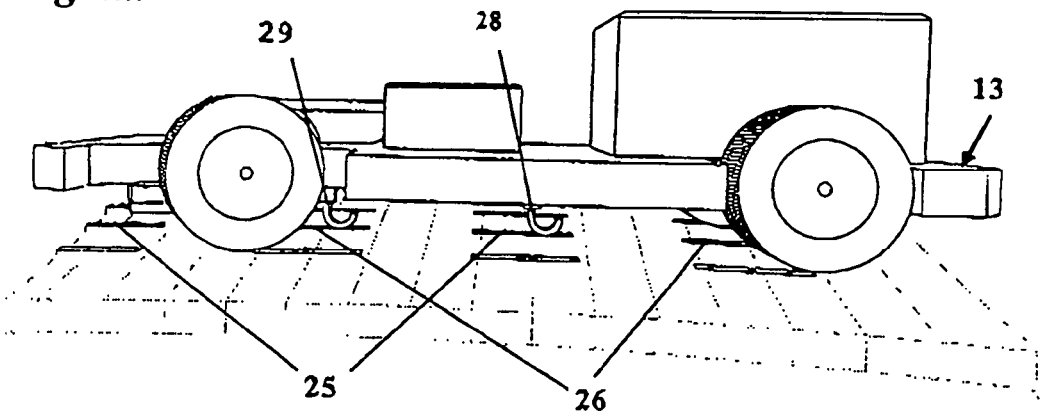
FIG. 11 is a perspective schematic diagram of a vehicle on a roadway part, featuring interruptions in the guiding tracks, which additionally form electric contacts.

Another embodiment with power supply through sliding contacts 28, 29, combined with the approach featuring periodic interruptions 27 of the guiding track, known from FIG. 9 is illustrated schematically in FIG. 11. Hereunto, the segments 25 and 26 of the conducting track following on each other are of different electric potential at any time, so that two sliding contacts 28, 29, situated one after another along the longitudinal axis of the vehicle 13, are sufficient for the power admission from the roadway 1.

Figure 12:
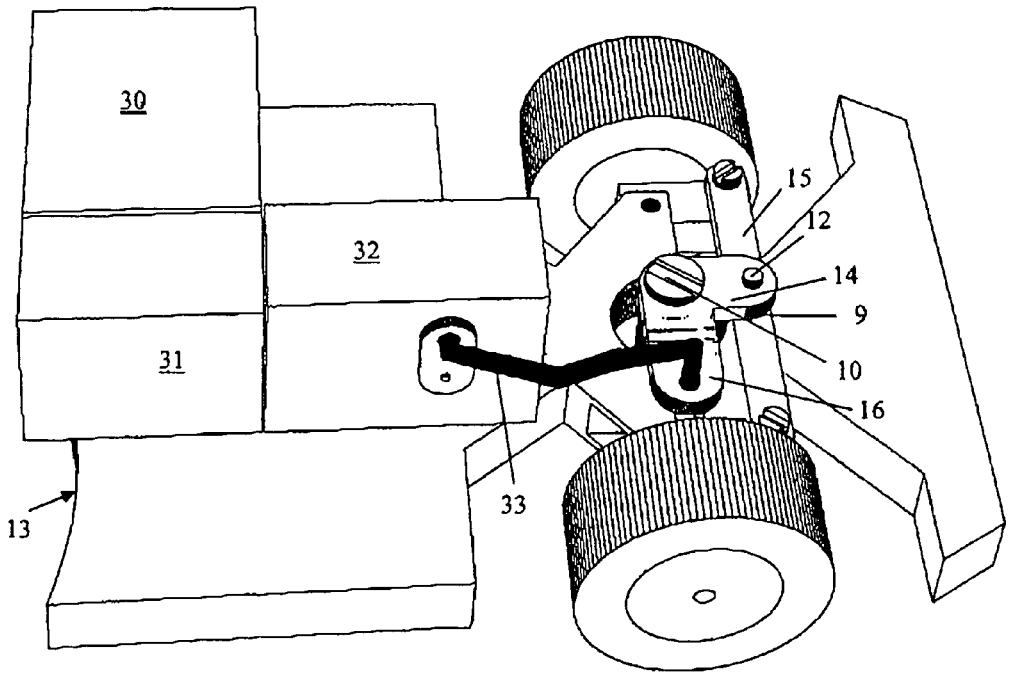
FIG. 12 is a perspective partial schematic diagram of a vehicle with a control lever that is free of play, and a coupler between servomotor and servo gearbox.
Figure 13:
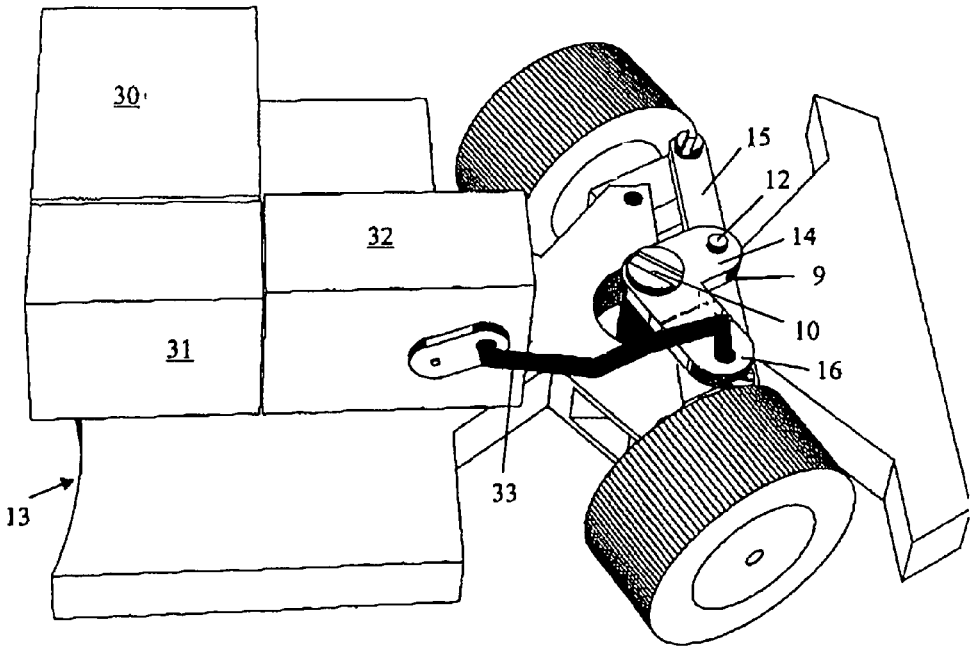
FIG. 13 is the vehicle to FIG. 12 in steered left state.

A further variation, decreasing the reaction time of the servomechanism in case of intervention by the player, is shown in FIGS. 12 and 13. Here the control lever 33 is coupled flexibly, however, free of play with the steering mechanism by which upon an intervention by the player, no free space has to be overcome, and therefore the steering movement takes effect immediately. To guarantee hereunto the unrestricted magnetic guidance in the non-intervention case, a coupling 31 is foreseen between the servomotor 30 and the step-up gear unit 32. Then with intervention of the player, not only the servo motor is activated in the suitable direction, but simultaneously the coupling is activated, which couples it with the step-up gear unit, and therefore also mechanically to the control lever. After the intervention, the coupling is released immediately, by which the vehicle is steered again by the magnetic guiding track.

Figure 14:
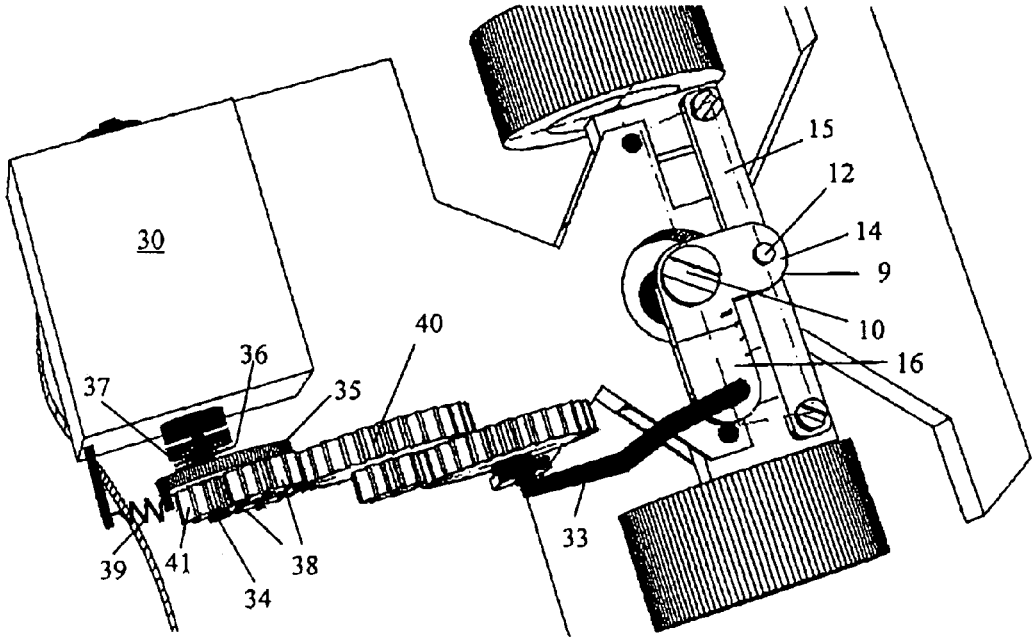
FIG. 14 is a perspective partial view of a vehicle with steering-mechanism and servomechanism featuring an automatic coupler.
Figure 15:
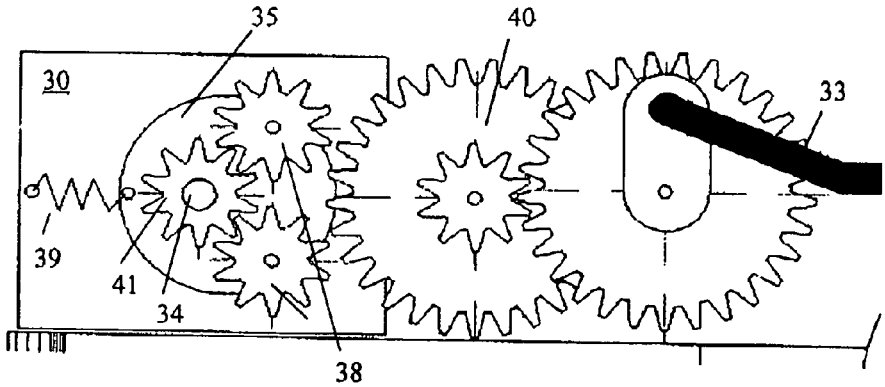
FIG. 15 is a side view of an automatic coupler for an intervening control in neutral, disengaged state.
Figure 16:
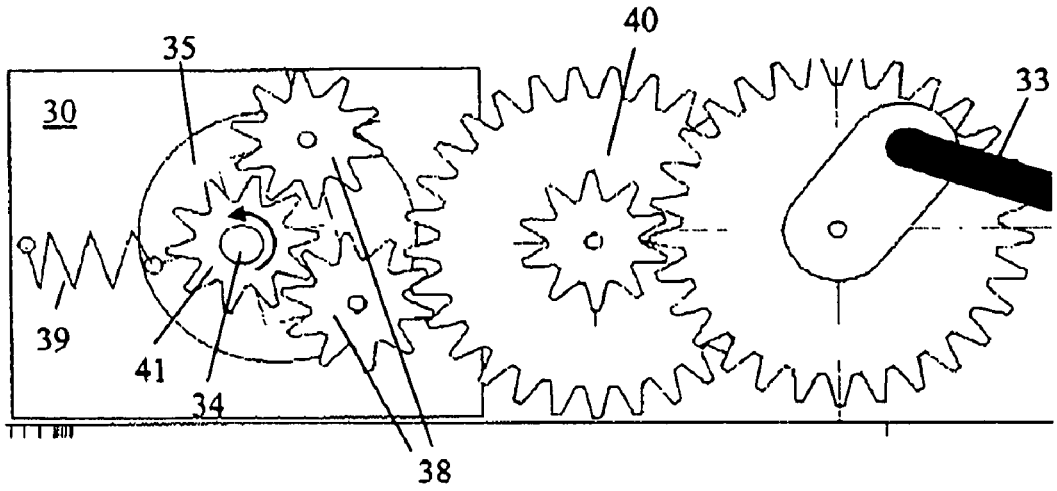
FIG. 16 is a side view of an automatic coupler for an intervening control in active, engaged state.

This coupling can be both designed for explicit activation (e.g., electromagnetically) and remotely controlled together with the servomotor; or for automatic activation, which responds to the movement of the servomotor. FIGS. 14 to 16 show a possible embodiment of an automatic, mechanical coupling.

On the shaft 34 of the servomotor 30, a pendulum bob 35 is bedded in a pivoted way. It is slightly pressed by a spring 36 to the disc 37, which is firmly coupled with the motor shaft. On the pendulum bob, two coupling pinion gears 38 are bedded. If the servomotor is in powerless state, the pendulum bob is held by another spring 39 in neutral position. Besides, the force applied by spring 39 is lesser than the pressing force of spring 36, but higher than the force required to turn the motor shaft while the motor is powerless.

In this neutral position, the reduction gear 40 runs freely, permitting, hence, a free movement of the gear exit, which is coupled with the steering mechanism through the control lever.

If the servo motor 30 is set in motion, the spring 36 provides for the turn of the pendulum bob 35, by which, according to the direction of the rotation, one of the two coupling pinion gears 38 is moved between driving pinion 41 and reduction gear 40. As soon as it comes to the engagement of the gears, this is even supported by the torque delivered by the motor. If the motor is switched off, the spring 39 provides for turning back the pendulum bob 35 to the neutral position. In FIGS. 14 to 16 gears are shown, however, where also friction gears are possible.

The invention claimed is:

1. A toy vehicle and track system comprising:

vehicles propelled independently of each other, and a roadway including lanes with one or more adjoined ferromagnetic guiding tracks;

wherein said vehicles comprise at least one piloting magnet, which follows by magnetic coupling with a guiding track, said track to steer directly or indirectly the vehicle, and an additional steering mechanism providing means to steer the vehicle independently from the said tracks by a remote control;

wherein a direct steering of the vehicle by said means of magnetic coupling, an interfering steering force applied by the said steering mechanism to change the lanes is dimensioned to override the magnetic coupling force.

2. A toy vehicle and track system as set forth in claim 1, wherein the ferromagnetic guiding tracks have periodical interruptions following on each other.

3. A toy vehicle and track system as set forth in claim 1, wherein the said piloting magnet, and a remotely controlled servo mechanism, are mechanically coupled with a steering mechanism.

4. A toy vehicle and track system, as set forth in claim 3, wherein the said steering gear is implemented as a steering trapezoid whose tie rod is coupled mechanically with a pivoting arm, pointing in the driving direction, whose outer end carries the said pilot magnet.

5. A toy vehicle and track system as set forth in claim 4, wherein a pivoting arm firmly linked with a steering shaft, is connected stiffly to an angle lever, whose one arm is connected moveably by a steering plug with the tie rod, and whose other arm features another plug engaging in the cut of a control lever of a remotely controlled servo mechanism.

6. A toy vehicle and track system as set forth in claim 5, wherein the said angle lever carries at each of its ends one of the steering plugs, whereas the steering plug connected to the tie rod, is directed downwards from the angle lever, and the plug en-gaging in the cut of the control lever is directed upwards from the angle lever.

7. A toy vehicle and track system as set forth in claim 3, wherein a pivoting arm firmly linked with a steering shaft, is connected stiffly to an angle lever, whose one arm is hinged by a steering plug to the tie rod, and whose other arm is non-rigidly connected to the control lever of a step-up gear unit, and this unit can be connected to the drive shaft of a servo motor, through either a coupling automatically engaged by the servo motor, or an arbitrarily operated coupling to the intervening steering system, and in the disengaged state, a sufficient freedom of movement of the control lever is foreseen to allow the magnetic guidance, and both the said servo motor and the said arbitrary coupling are operated by a remote control.

8. A toy vehicle and track system, as set forth in claim 1, wherein the said vehicles have at least two electric sliding contacts, which are in conductive con-tact with the conducting tracks or to conductor segments following a track.

9. A toy vehicle and track system, as set forth in claim 8, wherein at least one of at least two electric sliding contacts of the vehicles are in conductive contact with the ferromagnetic guiding track.

10. A toy vehicle and track system as set forth in claim 8, wherein a conducting track has periodic interruptions following on each other and contact segments following on each other, with different electric potential at any time, whereas the vehicles have two sliding contacts situated one after another along the longitudinal axis on the underside, which therefore serve for the admission of the voltage applied to the said contact segments.

* * * * *